United States Patent [19]

Adams

[11] 4,127,222

[45] Nov. 28, 1978

[54] SEWING THIMBLE

[76] Inventor: Roberta V. Adams, 17810 Superior St., Northridge, Calif. 91325

[21] Appl. No.: 847,169

[22] Filed: Oct. 31, 1977

Related U.S. Application Data

[63] Continuation-in-part of Ser. No. 745,466, Nov. 26, 1976, abandoned.

[51] Int. Cl.[2] ..... D05B 91/04

[52] U.S. Cl. ..... 223/101; 2/21

[58] Field of Search ..... 223/101; 2/21

[56] References Cited

U.S. PATENT DOCUMENTS

| | | | |
|---|---|---|---|
| 649,310 | 5/1900 | Iles | 223/101 |
| 805,297 | 11/1905 | Huntington | 223/101 |
| 837,896 | 12/1906 | Bourne | 223/101 |
| 1,916,921 | 7/1933 | Dougan | 2/21 |
| 2,056,555 | 10/1936 | Auster et al. | 2/21 |
| 2,157,293 | 5/1939 | Lenta | 2/21 |
| 2,207,672 | 7/1940 | Levey | 223/101 |
| 3,348,541 | 10/1967 | Loebeck | 2/21 |

*Primary Examiner*—Louis Rimrodt

*Attorney, Agent, or Firm*—Francis X. Lo Jacono, Sr.

[57] ABSTRACT

An improved sewing thimble having an elongated, tubular body consisting of a pliable material, such as rubber, wherein a plurality of vent holes are disposed about the annular body portion, the inner bore thereof being designed to conform to the average finger, including those having extended fingernails. The forward head portion of the thimble is enlarged with a thickened area of a hard rubber or plastic to allow for forceful engagement with a needle to be threaded. Alternative arrangements include a protective shield embedded within the head portion and a threading-and-cutting device mounted to the thimble at the tip of the enlarged head thereof.

1 Claim, 7 Drawing Figures

SEWING THIMBLE

CROSS REFERENCE TO RELATED APPLICATION

This application is a continuation-in-part of the following:

Inventor: Roberta V. Adams
Title: SEWING THIMBLE
Ser. No.: 745,466
Filed: Nov. 26, 1976, now abandoned.

BACKGROUND OF THE INVENTION

1. Field of the Invention

This invention relates generally to a thimble used in conjunction with sewing the the like and, more particularly, to a sewing thimble that consists of a pliable material, such as rubber or plastic, wherein the bore thereof substantially conforms to the average finger, and having a fingernail receiving member which is also pliable to conform to the shape of a fingernail disposed therein.

2. Description of the Prior Art

As is well known in the art, various problems and difficulties are encountered in providing suitable means for hand stitching wherein the needle must be forced into the fabric by use of finger pressure.

The well-known metal thimble is still extensively in use today — yet it leaves much to be desired in the way of wear and usefulness. This thimble comprises a somewhat-truncated cap having a standard conical bore to receive the tip of the finger.

Due to the fact that these thimbles are made of metal, they are, therefore, not flexible to allow the user thereof the necessary freedom of all fingers. Thus, the known thimble is very limited in its operation and hinders the full use of the sewing hand.

SUMMARY OF THE INVENTION

The present invention comprises a new sewing thimble having an elongated, hollow body with a reinforced open end whereby the middle finger of the hand is readily accepted within the bore, the bore having the general configuration of the average finger. To allow the freedom of the hand and the sewing middle finger, the thimble comprises a flexible rubber or soft plastic material so as to readily conform to most fingers. To aid in accommodating the insertion and removal of the finger therein, the elongated body portion includes a plurality of vent holes, wherein the holes terminate adjacent the forward, enlarged head member provided by a thickened layer of rubber or plastic. The outer surface of the head, the portion on the front of the finger, is covered with little indentations to facilitate engagement of the needle and prevent slippage of the needle when being pushed into the article being sewn.

In some cases, where the material being sewn is extra thick or is very difficult to penetrate or pierce, a small metal plate can be interposed within the engaging face of the head portion.

Alternative arrangements include a thimble having an elongated tip member adapted to receive a fingernail therein — whereby a person having long fingernails, and who generally was incapable of using a thimble, can now do so.

Still another arrangement provides a device for threading a needle and cutting threads. This device is secured to the tubular body rearward of the head member.

OBJECTIVES AND ADVANTAGES OF THE INVENTION

The present invention has for an important objective a provision wherein any size finger can be readily accommodated within a bore having the general configuration of the average middle finger.

It is another objective of the invention to provide a new type of thimble wherein the thimble comprises a soft, pliable material of either plastic or rubber, thereby making it capable of being stretched.

It is further another objective of the invention to provide a thimble that allows full use of the finger, yet still provides the complete protection given by a thimble.

It is further an objective of the invention to provide a thimble of this character that allows greater improvement in its use and operation in conjunction with piercing instruments, such as needles.

It is another objective of the invention to provide a thimble of this character that is simple but rugged in construction.

And still another objective of the present invention is to provide a device of this character that is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

DESCRIPTION OF THE DRAWINGS

Referring more particularly to the accompanying drawings, which are for illustrative purposes only.

DESCRIPTION OF THE PREFERRED EMBODIMENT

Figure 1:
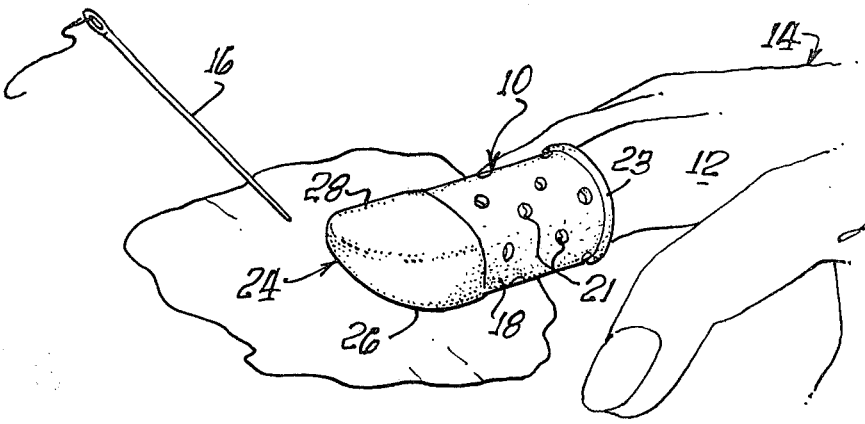
FIG. 1 is a pictorial view showing the present invention mounted to the middle finger of a user.

Referring more particularly to FIG. 1, there is shown a sewing thimble, generally indicated at 10, said thimble being positioned on the tip of the middle finger 12 of hand 14. The thimble will be used in the normal manner with a sewing needle 16, or a like piercing instrument.

The thimble 10 comprises a pliable, flexible material of rubber or combination rubber-plastic material so as to stretch and conform to the various sizes and shapes of fingers.

Figure 2:
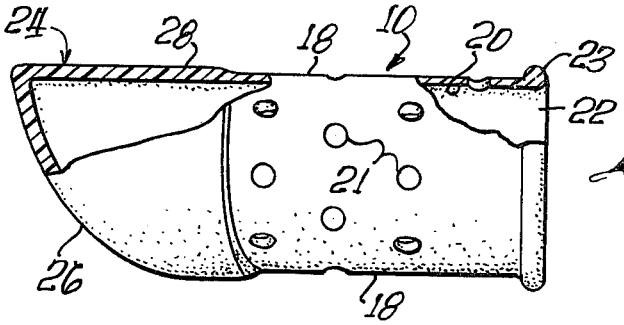
FIG. 2 is an enlarged, side-elevational view thereof with a portion broken away.

As better illustrated in FIG. 2, the thimble includes an elongated, tubular body portion 18 formed by a thin annular wall defining an elongated bore 20, said wall having a plurality of vent holes 21 disposed therein. These holes allow for ease in inserting and removing the finger so as to prevent air from being trapped therein. In addition, it allows the finger positioned therein to "breathe".

The open end 22 of body 18 is provided with an annular rib member 23 so as to reinforce the opening and prevent the opened end from collapsing.

The opposite end of thimble 10 includes an enlarged head member 24 forming a needle-engaging means having a thickened body of hard rubber or plastic so as to prevent the needle from penetrating therethrough. Said head comprises a forward-engaging surface that slopes downwardly and rearwardly at 26, with a thickened, upper surface 28. Forward surface 26 protects the sensitive tip of the finger, and the upper or top surface 28 protects the fingernail of the user.

Accordingly, it should be noted that bore 22 is formed with the general configuration of the average finger to provide, in most cases, a comfortable fit that gives complete freedom of movement to finger 12. It is also contemplated that the entire surface of head 24 will be roughened to prevent the needle from slipping from the thimble when force is applied thereto.

Figure 3:
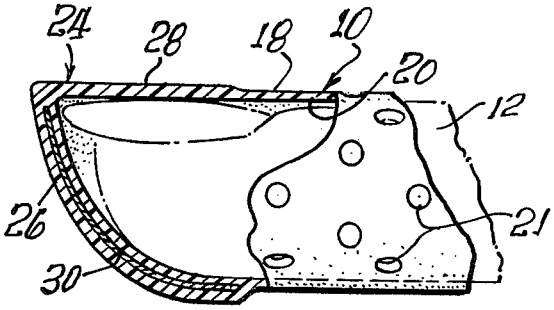
FIG. 3 is a partial, cross-sectional view of an alternative arrangement wherein a protective plate is interposed in the forward head member.

Referring now to FIG. 3, the head member 24 includes a protective plate 30 of metal or hard plastic interposed within forward wall 26. This plate will allow extreme pressure or force to be applied to needles that are used on heavy materials such as rugs and the like, wherein the end of the needle can not be felt on the tip of finger 12. There are many conditions where great pressure is required during sewing.

Figure 4:
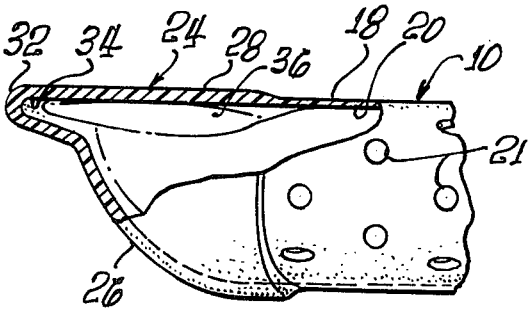
FIG. 4 is an alternative embodiment having an extended protrusion forming a recess to receive an elongated fingernail.

There is shown in FIG. 4 another embodiment of the present invention wherein head 24 includes an extended tip member 32 defining an extending recess 34. Recess 34 is so formed as to accommodate a long fingernail 36. Most women who pride themselves in growing long fingernails are generally restricted in the art of sewing due to the lack of a thimble that will accommodate and protect their fingernails. However, with the above-described device, this is no longer true.

In any of the heretofore-described embodiments, an additional element is contemplated — that being a threading-and-cutting means, indicated at 40.

Figure 5:
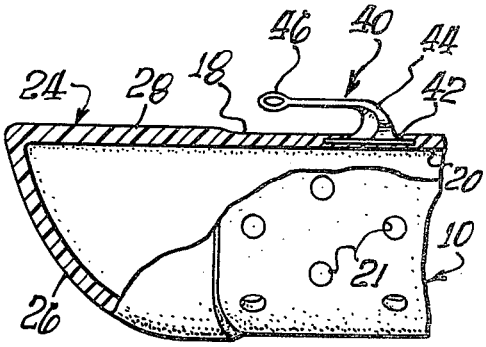
FIG. 5 is another arrangement of the present invention which includes a device for threading needles and cutting threads.

The threading-and-cutting means comprises a base member 42 mounted to the elongated body member 18 rearwardly of said head member 24, as seen in FIG. 5. An extended arm 44 is bent forwardly and has a cutting edge 45 adjacent the base member 42, said arm projecting forwardly and terminating with a threading point 46 which includes a pliable loop member. Thus, when the right length of thread is cut by the cutting edge, the thread is then threaded through the eye of the needle with point 46.

Figure 6:
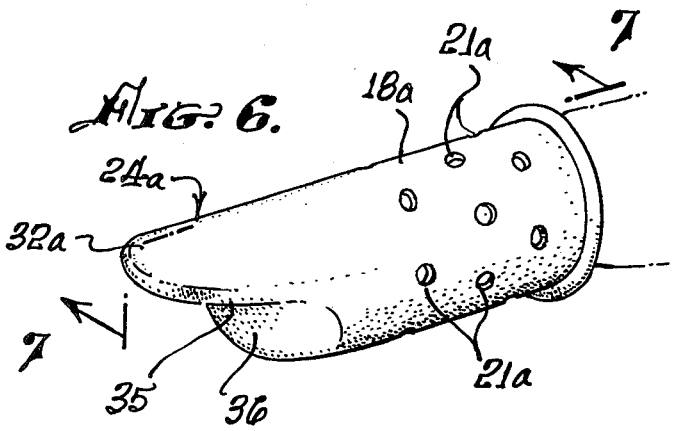
FIG. 6 is a perspective view of a further arrangement of the present invention.
Figure 7:
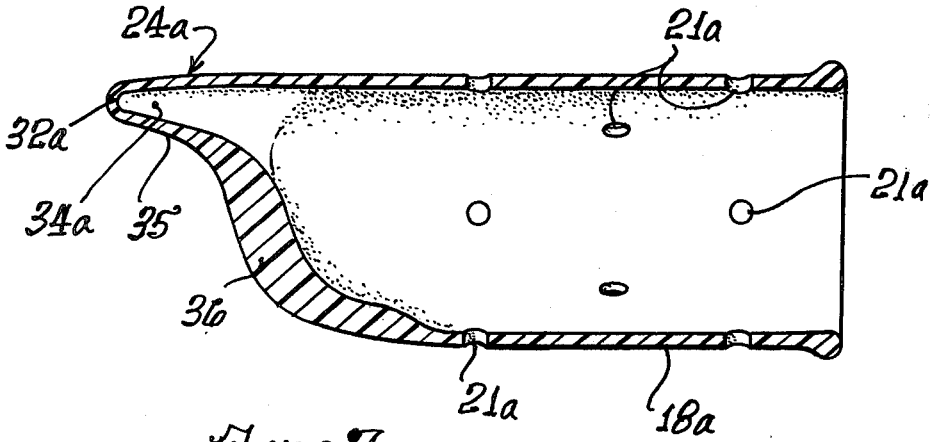
FIG. 7 is a cross-sectional view thereof taken along line 7—7 of FIG. 6.

Referring now to FIG. 6, there is shown still another alternative arrangement of the present sewing thimble wherein the elongated tubular body **18*a* is formed with a thin, stretchable rubber or plastic material, as previously described. The body 18*a* includes a plurality of vent holes 21*a*, as also indicated in the previous figures. In this arrangement, head member 24*a* is also provided with an extended tip member 32*a*, defining an elongated recess 34*a* which is formed to accommodate various sizes of fingernails. It is important to note that extension tip member 32*a* is a continuation of the main body 18*a*; and that the extension tip is formed with the same pliable thin wall as body 18*a***. That is, the thin pliable wall is stretchable, and thereby allows various sized fingernails to be readily received therein.

Accordingly, when a finger having a long nail is inserted in the thimble body and the nail is received in recess **34*a*, the tip 32*a* will stretch to accommodate the particular length of the nail. Thus, tip member 32*a* includes a lower wall member 35 of thin, flexible stretch material. This wall is integrally formed to a thickened body portion 36** of hard rubber to provide a needle-engaging means disposed in front of the sensitive tip of the finger in order to prevent the needle from penetrating therethrough — yet allowing for the stretchability of the fingernail-receiving tip member.

The invention and its attendant advantages will be understood from the foregoing description; and it will be apparent that various changes may be made in the form, construction and arrangement of the parts of the invention without departing from the spirit and scope thereof or sacrificing its material advantages, the arrangement herein before described being merely by way of example; and I do not wish to be restricted to the specific form shown or uses mentioned, except as defined in the accompanying claims.

I claim:

1. A sewing thimble comprising:

an elongated body member defining an inner bore having a contour of a finger, wherein said body is formed from a pliable stretch material;

a needle-engaging head member formed on one end of said body wherein said head member is formed of a hard material having a thickness at least twice that of said body member, and including a forward engaging surface that extends downwardly and rearwardly to cover the tip of the finger, said surface of said head member being roughened to provide a non-slip surface to allow the end of the needle to engage therewith, wherein said head member further includes a protective plate laminated and interdisposed therein adjacent the forward engaging surface thereof;

an extended tip member of thin, flexible stretch material defining a fingernail-receiving section that is stretchable to accommodate various lengths of fingernails;

a plurality of vent holes disposed in said body member rearwardly of said head member;

said body member having an open end to receive said finger therein; and an annular rib formed about said open end to prevent collapsing thereof.

* * * * *